US005499608A

United States Patent [19]

Meister et al.

[11] Patent Number: 5,499,608

[45] Date of Patent: Mar. 19, 1996

[54] METHOD OF STAGED ACTIVATION FOR ELECTRONICALLY ACTUATED FUEL INJECTORS

[75] Inventors: Steven F. Meister, Chillicothe; Charles R. Miller, Metamora, both of Ill.

[73] Assignee: Caterpillar Inc., Peoria, Ill.

[21] Appl. No.: 492,353

[22] Filed: Jun. 19, 1995

[51] Int. Cl.[6] ..... F02M 41/00

[52] U.S. Cl. ..... 123/467; 123/478

[58] Field of Search ..... 123/446, 467, 123/478, 480

[56] References Cited

U.S. PATENT DOCUMENTS

| | | | |
|---|---|---|---|
| 3,689,205 | 9/1972 | Links | 417/401 |
| 4,426,977 | 1/1984 | Taplin et al. | 123/446 |
| 4,440,133 | 4/1984 | Jourde | 123/446 |
| 4,546,739 | 10/1995 | Nakajima et al. | 123/299 |
| 4,603,671 | 8/1986 | Yoshinaga et al. | 123/467 |
| 4,621,599 | 11/1986 | Igashira et al. | 123/300 |
| 4,712,528 | 12/1987 | Schaffitz | 123/446 |
| 5,057,734 | 10/1991 | Tsuzuki et al. | 123/478 |
| 5,150,684 | 9/1992 | Jun | 123/446 |
| 5,156,132 | 10/1992 | Iwanaga et al. | 123/467 |
| 5,375,576 | 12/1994 | Ausman et al. | 123/467 |

*Primary Examiner*—Thomas N. Moulis
*Attorney, Agent, or Firm*—Michael B. McNeil

[57] ABSTRACT

A staged activation logic is utilized in the transition zone of operation for a fuel injector having an electronically actuated valve that opens to permit flow of high pressure fluid into the injector to initiate injection when activated but is biased to close when deactivated to end injection. Many different types of injectors could potentially utilize the present invention, regardless of whether the high pressure fluid is a high pressure hydraulic actuation fluid or high pressure fuel. The transition zone of operation corresponds to that range of activation durations for the injector in which the electronically actuated valve experiences a bouncing phenomenon because the valve member bounces off of its stop and closes prematurely. If it is determined that the desired amount of fuel to be injected during the next cycle falls within the transition zone of operation, then a revised activation duration for the electronically actuated valve is calculated. The valve is then quickly activated and deactivated with a staging pulse to raise pressure within the injector before actually initiating the injection of fuel. After a brief deactivation period, the electronically actuated valve is actuated for the revised activation duration. If the originally calculated amount of fuel falls outside of the transition zone then the electronically actuated valve is activated in a conventional manner.

9 Claims, 3 Drawing Sheets

METHOD OF STAGED ACTIVATION FOR ELECTRONICALLY ACTUATED FUEL INJECTORS

TECHNICAL FIELD

The present invention relates generally to fuel injectors, and more particularly to a method of controlling a fuel injector having an electronically actuated valve that opens to permit flow of high pressure fluid into the injector to initiate injection when activated but is biased to close when deactivated to end injection.

BACKGROUND ART

There are many types of known electronically actuated fuel injectors that could benefit from the present invention. For instance, one such injector might be a Caterpillar hydraulically-actuated electronically-controlled fuel injector system (see e.g. U.S. Pat. No. 5,121,730), which has an electronically actuated valve that opens to permit flow of high pressure actuation fluid into the injector to initiate injection. When deactivated, the valve is biased to close in order to end injection. The valve acts as a switch to start and stop fuel injection at precise times during an engine cycle. Those skilled in the art will appreciate that the valve's motion must be both fast and complete (fully opened) to produce desired injection characteristics. This type of injection system is time based, meaning that the amount of fuel injected is a function of the amount of time that the valve is opened. In general, injection duration increases with an increase in valve activation duration; however, most valves have a zone of operation in which an increase in valve activation duration actually causes a decrease in the amount of fuel injected. This phenomenon is believed due to the valve member, be it a spool valve or a popper valve, bouncing off its stop because the valve is commanded to close before the valve has reached its fully opened position. In other words, the valve is commanded to close before the valve member has reached its fully open position but its opening momentum causes the valve member to bounce off its stop and close more quickly than it otherwise would under the action of its return spring. Hereinafter, the term "transition zone" will be used to refer to that zone of operation of the injector system in which the electronically actuated valve exhibits the bouncing phenomenon.

At higher injection flows, the spool or popper valve member is pushed and held against its stop during a relatively long injection duration. In some instances when fuel demand is low, such as in low load or low rpm conditions, the valve member bouncing phenomenon can cause the engine to behave somewhat erratically. This erratic behavior is believed due to the fact that, in the transition zone of operation, an increase in valve activation duration causes a decrease in the amount of fuel injected. The valve member bouncing phenomenon causes the valve to close prematurely in a non-linear manner that is very difficult to predict. There is no known prior art that recognizes this problem or proposes a solution thereto.

The present invention is directed to providing a method of staging activation pulses to the injector in a way that avoids the problems created by the valve member bouncing phenomenon.

DISCLOSURE OF THE INVENTION

The present invention comprises a method of fuel injection in a fuel injector having an electronically actuated valve that opens to permit flow of high pressure fluid into the injector to initiate injection when activated but is biased to close when deactivated to end injection. First, the desired amount of fuel to be injected is determined and a valve activation duration is calculated based upon this desired amount of fuel. Next, a comparison is made to determine whether that activation duration corresponds to a transition zone of operation for the electronically actuated valve. The transition zone of operation being that range of activation durations that result in the valve member bouncing behavior. If it is determined that the activation duration is within the transition zone, then a revised activation duration is calculated. Next, the electronically actuated valve is activated briefly and then deactivated. A short time later, the electronically actuated valve is reactivated for the revised activation duration. The valve is then deactivated at the end of the revised activation duration. If it is determined that the originally calculated activation duration is outside of the transition zone, then the valve is activated for the complete activation duration and then deactivated.

BEST MODE FOR CARRYING OUT THE INVENTION

Although the present invention is described in relation to a hydraulically-actuated electronically-controlled fuel injector, such as Caterpillar hydraulically actuated, electronically controlled unit injector model HI150, the present invention finds potential application to any fuel injector whose operation is controlled at least in part by an electronically actuated valve. Many of these valves are required to operate in a transition zone of operation in which the physical limitations of the valve cause the valve member to bounce off its back stop and alter the expected behavior of the valve. This region of operation is identified in FIG. 1 as the transition zone.

Figure 2:
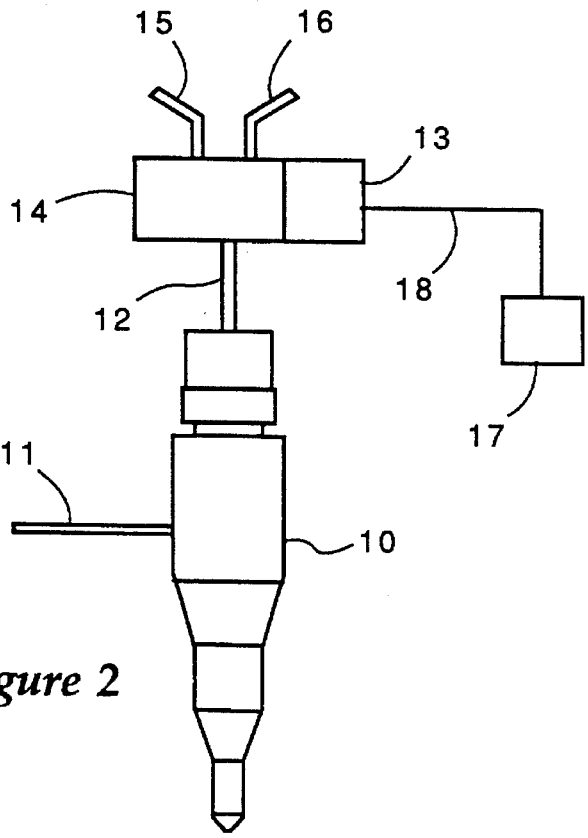
FIG. 2 is a side elevational view of one type of fuel injector having an electronically actuated valve.

Referring now to FIG. 2, a hydraulically actuated electronically controlled fuel injector 10 is fed low pressure fuel through fuel supply line 11 and is activated by high pressure hydraulic fluid, such as oil, through actuation fluid conduit 12. An electronically actuated valve 14 alternately exposes conduit 12 to high pressure hydraulic fluid supply line 15 and low pressure hydraulic fluid return line 16. When valve 14 is opened, high pressure hydraulic fluid flows through line 15 through valve 14 into conduit 12 and eventually into injector 10, where it pressurizes the fuel in a conventional manner, such as by known intensifier piston/fuel pressurization chamber techniques to initiate injection. Valve 14 is actuated by a solenoid 13 and is controlled via communication line 18 by a computer 17. As known in the art, the computer senses engine operating conditions, vehicle load conditions, etc. to determine the desired amount of fuel to be injected in each engine cycle. These desired injection amounts are typically determined by bench tests and/or mathematical modeling techniques.

This type of injection system is commonly referred to as being time based, meaning that the amount of fuel injected is a function of the amount of time that electronically actuated valve 14 is opened. This time can further be split into three parts: the time it takes for the valve to completely open, the time it is held at the full open position (see spool stop 26 of FIG. 3), and the time it takes to return to the closed position after being deactivated. Electronic control software operating within computer 17 sends out logic pulses to solenoid 13 that vary with engine operating conditions. The length of the logic pulse dictates the amount of time that the spool valve is energized away from its normally biased closed position.

Figure 3:
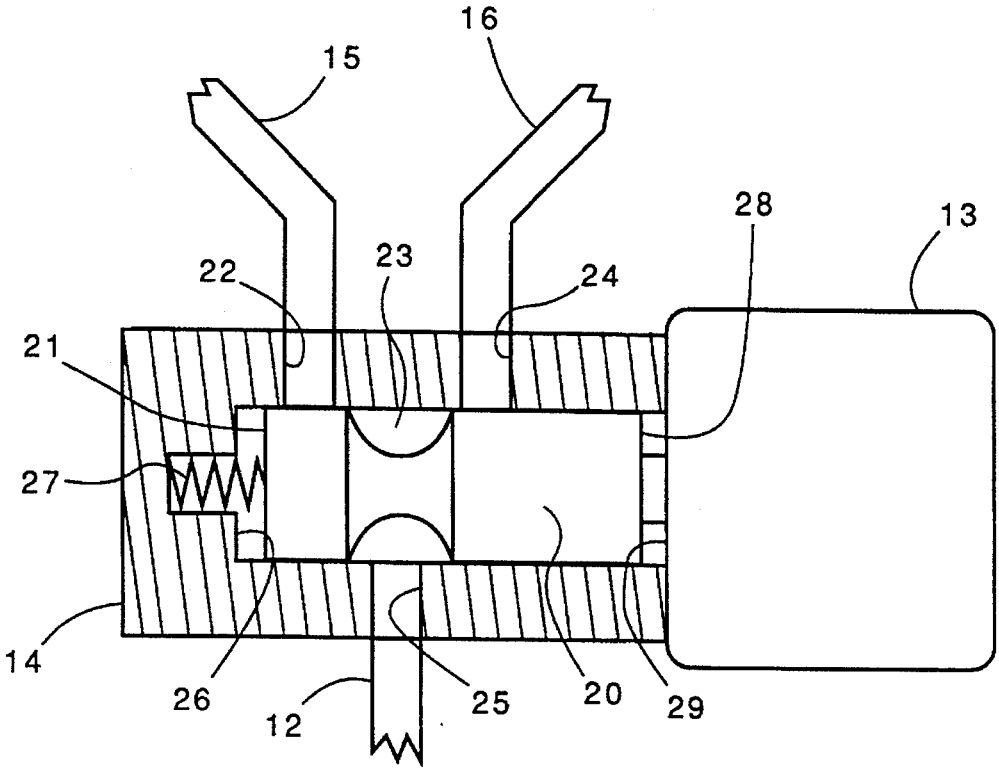
FIG. 3 is an enlarged sectioned side elevational view of the electronically actuated spool valve shown in FIG. 2.
Figure 4:
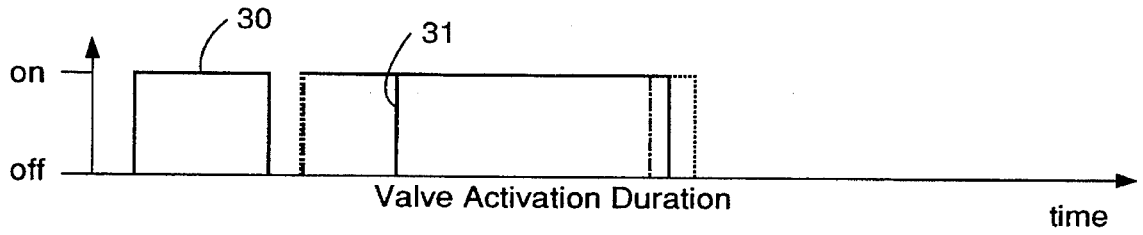
FIG. 4 is a graph showing three different valve activation duration examples for the fuel injector illustrated in FIG. 2.

Referring now to FIG. 3, an internal view of a typical spool valve 14 will be useful in illustrating the problem overcome by the present invention. Valve 14 is shown with spool 20 moving between its open and closed positions. When energized, solenoid 13 pushes spool 20 to the left against the action of return spring 27 until end 21 rests against spool stop 26. When in the fully open position, high pressure hydraulic fluid flows through supply line 15, into conduit 22 around annular space 23, into conduit 25 and out through conduit 12 into the injector. When solenoid 13 is deactivated, return spring 27 forces spool 20 to the right until end 28 abuts surface 29. When in this position, high pressure hydraulic fluid within the injector is allowed to flow out of conduit 12 into passage 25, around annular chamber 23 into passage 24 and out into hydraulic fluid return line 16. As shown in FIG. 3, spool valves often have an intermediate position in which no passages are open.

Referring back to FIG. 1, Tmin corresponds to the minimum amount of time that solenoid 13 must be energized in order to begin the actual injection of fuel from the injector. If solenoid 13 is activated for any amount of time less than Tmin, spool 20 may move to the left far enough to open supply line 15, but the pressure within injector 10 will not reach the threshold necessary to open the nozzle check and begin the injection of fuel. The range of logic pulse durations of FIG. 1 between Tmin and the beginning of the transition zone corresponds to that zone of operation for valve 14 in which solenoid 13 is activated sufficiently long for spool 20 to open annular chamber 23 to supply line 15, but is deactivated before end 21 contacts spool stop 26. This area of operation typically corresponds to extremely low fuel injection demands, but this area of operation is not generally favored because of the non-linear behavior of the injector.

In the area of the transition zone, solenoid 13 is activated sufficiently long to open conduit 12 to high pressure supply line 15 and before end 21 has contacted spool stop 26; however, the left moving momentum of spool 20 continues after solenoid 13 is deactivated such that end 21 bounces off of spool stop 26 adding energy to spool 20 and hastening its return to its rightward closed position under the additional action of return spring 27. In this zone of operation, the behavior of the injector is not only non-linear but also counter intuitive since a longer solenoid activation duration actually results in a smaller amount of injected fuel because of the bouncing phenomenon observed in spool 20. To the right of the transition zone, the injector behaves relatively linearly with respect to the logic pulse duration acting on solenoid 13 because the solenoid is activated long enough push end 21 into contact with spool stop 26 where it is held for an amount of time corresponding to a desired amount of fuel to be injected. The present invention is primarily concerned with controlling valve 14 in the transition zone in a way that avoids the bouncing phenomenon but could equally well be utilized in other areas of FIG. 1 if certain desirable injection characteristics are required.

Figure 1:
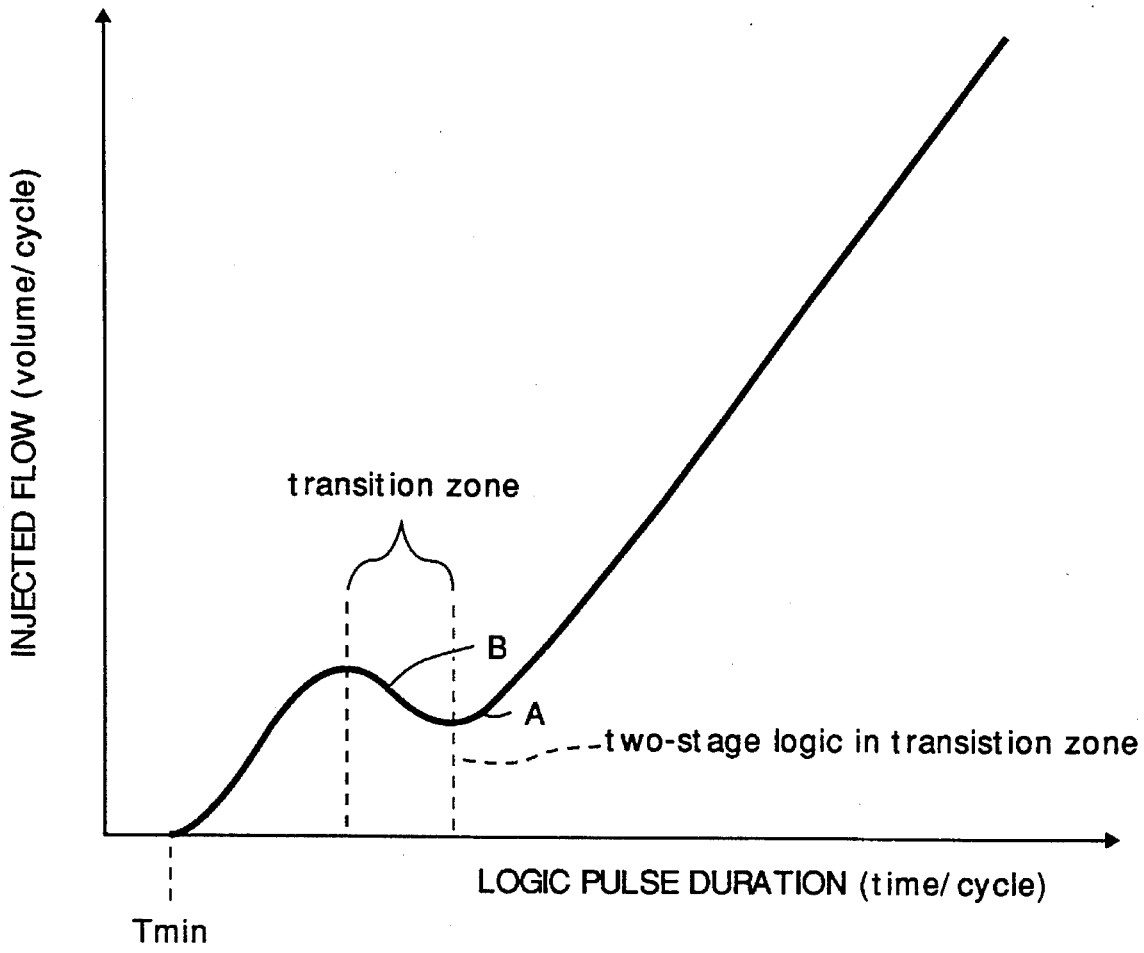
FIG. 1 is a graph of injected flow volume per cycle versus logic pulse duration per cycle for a fuel injector having an electronically actuated valve that exhibits non-linear behavior in a transition zone.
Figure 5:
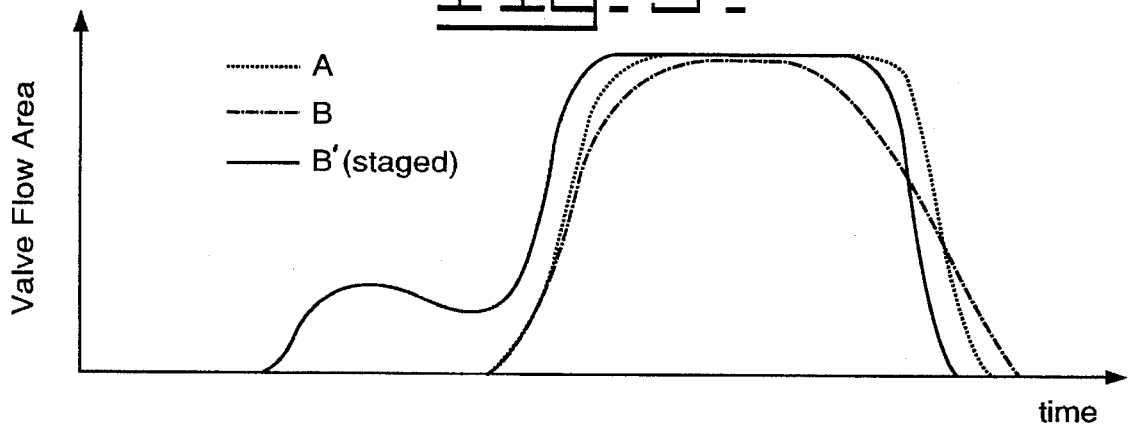
FIG. 5 is a graph of valve flow area versus time for the three different valve activation duration examples shown in FIG. 4.
Figure 6:
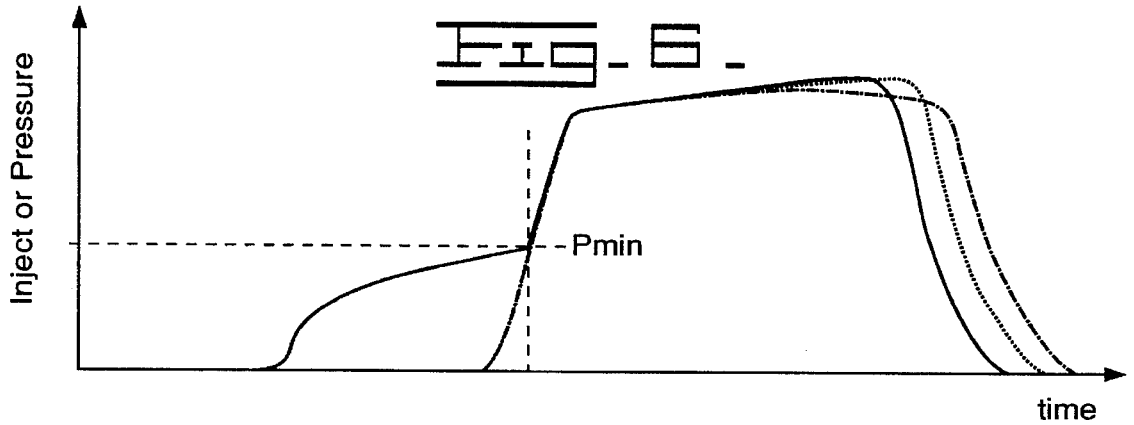
FIG. 6 is a graph of injector pressure versus time corresponding to the three valve activation duration examples of FIG. 4.
Figure 7:
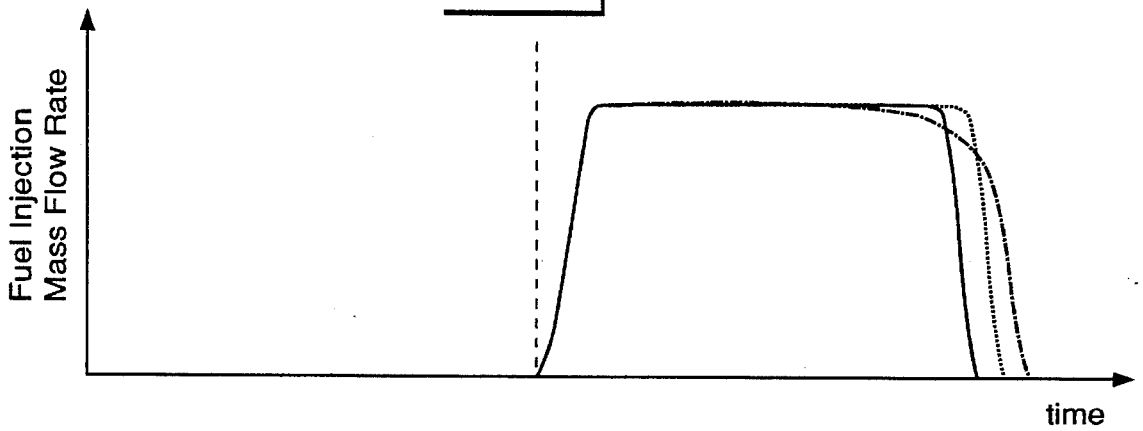
FIG. 7 is a graph of fuel injection mass flow rate versus time for the valve activation duration examples of FIG. 4.

Points A and B taken from the graph of FIG. 1 are shown plotted for a number of variables in FIGS. 4–7, which are useful in illustrating time delays and internal behavior of the injector. For purposes of comparison (ignoring timing considerations), logic pulses for curves A and B are shown as being initiated at the same time in FIG. 4. In the case of curve A, the valve is activated for a duration sufficiently long that the spool 20 is held against spool stop 26, which corresponds to the flat portion of the curve shown in FIG. 5. As can be seen in FIGS. 6 and 7, pressure within the injector initially builds until passing through a threshold pressure Pmin, which corresponds to the minimum pressure in the injector necessary to begin fuel injection as shown in FIG. 7. When the solenoid 13 is deactivated, the spool begins its movement toward a closed position under the action of return spring 27 until conduit 12 is exposed to low pressure return line 16 allowing pressure within the injector to quickly fall ending the injection event.

Curve B corresponds to the transition zone shown in FIG. 1. In this case, the valve activation duration is shorter than that of curve A, but the actual amount of fuel injected is greater than that of curve A because of the behavior of valve 14 discussed earlier. In particular, curve B of FIG. 5 shows that the spool 20 is not held against spool stop 26.

In order to avoid the undesirable bouncing phenomenon encountered in the transition zone shown in FIG. 1 (see curve B of FIGS. 4–7), the present invention utilizes the two stage valve activation logic corresponding to curve B'. Staging pulse 30 briefly energizes solenoid 13 for a period sufficiently long to move spool 20 to a slightly open position. This permits flow of high pressure hydraulic fluid through supply 15 and into conduit 12 so that pressure within the injector builds but not sufficiently high to initiate injection. The delay between when the solenoid is activated and when hydraulic fluid begins to flow is illustrated in FIG. 5. Thus, the staging pulse 30 raises pressure within the injector in preparation for the actual injection event, which is created a short time later after a staging deactivation period when reactivated for a revised activation duration 31. The staging deactivation period between activation pulses 30 and 31 is preferably chosen such that fluid pressure within the injector does not drop significantly before the valve is reactivated. FIG. 6 shows how the staging activation pulse 30 and the staging deactivation period thereafter raise pressure within the injector in preparation for the injection event.

FIG. 5 shows that, although the revised activation duration of 31 of curve B' is significantly shorter than that of its counterpart curve B, the spool is held against its stop, similar to that of curve A. It is important to note that revised activation duration 31 is significantly shorter than its counterpart activation duration for curve B since the staging pulse 30 already has the valve 14 partially open. This is noteworthy because the staged strategy B' results in an identical fuel injection amount compared to conventional pulse curve B that occurs in the transition zone of operation for the injector. Nevertheless, the amount of fuel injected is equal for the two cases. The staging strategy avoids the need to operate the injector in a range that produces the non-linear and relatively unpredictable valve bouncing phenomenon.

Industrial Applicability

Because the valve bouncing phenomenon that the present invention seeks to avoid is a function of the valve's mass properties and their interaction with the other various components of the injector, implementation of the present invention into an injector system can require a significant amount of bench testing of the injector system. First, bench test and/or modeling techniques must be utilized to determine whether the valve bouncing phenomenon occurs over any portion of the operating range for the particular injector system. If the bouncing phenomenon does occur for a particular injector system, bench testing can quickly be utilized to ascertain the range of the fuel injection amounts for which the phenomenon occurs. The transition zone of operation for that particular injector system is set to encompass the range of activation durations that produce the undesirable valve bouncing phenomenon.

Before implementing the present invention it is also necessary to ascertain a minimum activation duration (see Tmin of FIG. 1) that corresponds to the minimum activation duration for the solenoid that is necessary to start the actual injection of fuel into the engine. The staging activation duration 30 (FIG. 4) is then chosen to be less than the minimum activation duration necessary to start fuel injection. Next, it is necessary to determine the amount of time that the electronically actuated valve can be deactivated, after being activated for the staging activation duration, before the fluid pressure within the injector drops significantly. This aspect of the invention is important because the staging pulse will be of no effect if the valve is allowed to return to its closed position venting pressure within the injector before the revised activation pulse duration is initiated (see pulse 31 of FIG. 4). The staging deactivation duration is then chosen such that, after the staging pulse, pressure within the injector remains relatively high. These durations are preferably ascertained utilizing bench tests.

After the transition zone, staging pulse duration and staging deactivation duration are chosen. It is then necessary to determine a revised shorter activation duration period necessary to inject a particular amount of fuel. The revised activation durations are then mapped against the amount of fuel actually injected preferably utilizing bench test techniques. Next, before the method of the present invention is actually incorporated into the onboard computer 17 (see FIG. 2) that controls the injector system, it might also be necessary to conduct some further bench testing to ascertain timing variations introduced by the staged pulse injection logic.

After all the characteristics discussed above are ascertained for a particular injection system, the onboard computer is equipped with special logic to ascertain whether the desired amount of fuel to be injected for the next engine cycle corresponds to a transition zone of operation for the electronically actuated valve. If within the transition zone of operation, a revised activation duration is calculated, utilizing a look-up table and/or formula that corresponds to the mapped revised activation durations determined with bench testing. Next, the electronically valve is actuated for a brief period corresponding to the staged activation duration determined earlier. The electronically actuated valve is then deactivated for a period of time corresponding to the staging activation duration determined earlier. Finally, the electronically actuated valve is reactivated for the revised activation duration. If it was determined that the originally calculated activation duration fell outside of the transition zone, then the electronically actuated valve is simply activated for the originally calculated activation duration in a conventional manner.

Those skilled in the art will appreciate that the principals of the present invention can be applied to any electronically actuated fuel injection system in which a valve, in some way, controls injection, and the valve experiences the undesirable bouncing phenomenon over some portion of its required range of operation. In other words, the present invention finds application in any injector system controlled by an electronically actuated valve, be it a spool valve as described above or some other type of valve such as a poppet valve. Furthermore, although the present invention has been illustrated with respect to a hydraulically actuated fuel injection system, the present invention could also find applicability in systems that utilize a mechanical means (e.g. cam and plunger) to create the necessary pressure for injection within the injector but still utilize an electronically actuated valve to control the injector. In any event, the above description is intended to serve only to illustrate the present invention, and is not intended to limit the scope of the present invention, which is defined solely in terms of the claims as set forth below:

We claim:

1. A method of fuel injection, comprising the steps of:

providing a fuel injector having an electronically actuated valve that opens to permit flow of high pressure fluid into the injector to initiate injection when activated but is biased to close when deactivated to end injection;

determining a desired amount of fuel to be injected;

calculating an activation duration;

determining whether the activation duration corresponds to a transition zone of operation for the electronically actuated valve;

if within the transition zone then:

calculating a revised activation duration;

activating the electronically actuated valve;

deactivating the electronically actuated valve;

reactivating the electronically actuated valve for said revised activation duration; and deactivating the electronically actuated valve at the end of said revised activation duration;

if outside the transition zone then:

activating the electronically actuated valve for said activation duration; and deactivating the electronically actuated valve at the end of said activation duration.

2. The method of claim 1, wherein said activation duration is greater than said revised activation duration.

3. The method of claim 1, wherein the transition zone determination step includes the steps of:

determining a range of activation durations for the electronically actuated valve in which the amount of fuel injected decreases with each increase in activation duration; and setting said transition zone to encompass range of activation durations; and determining whether said activation duration falls within said transition zone.

4. The method of claim 1, wherein the step of calculating a revised activation duration includes the steps of:

determining an amount of time that the electronically actuated valve must be activated to inject said desired amount of fuel when fluid pressure within the injector is significantly raised before injection is initiated; and setting said revised activation duration about equal to said amount of time.

5. The method of claim 1, further comprising the steps of:

determining a minimum activation duration necessary to start injection; and choosing a staging activation duration that is less than said minimum activation duration.

6. The method of claim 5, wherein the time between the activating step and the first deactivating step within the transition zone is about equal to said staging activation duration.

7. The method of claim 6, further comprising the steps of:

determining an amount of time that the electronically actuated valve can be deactivated, after being activated for said staging activation duration, before fluid pressure within the injector drops significantly;

choosing a staging deactivation duration about equal to said amount of time.

8. The method of claim 7, wherein the time between the first deactivating step and the reactivating step within the transition zone is about equal to said staging deactivation duration.

9. The method of claim 8, further comprising the steps of:

supplying low pressure fuel into the fuel injector;

supplying a high pressure fluid to the fuel injector; and pressurizing the fuel using the high pressure fluid when the electronically actuated valve is open.

* * * * *